US008500304B2

(12) United States Patent
Yu et al.

(10) Patent No.: US 8,500,304 B2
(45) Date of Patent: Aug. 6, 2013

(54) LED BULB

(75) Inventors: Guang Yu, Shenzhen (CN); Qian Xiang, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 311 days.

(21) Appl. No.: 13/041,450

(22) Filed: Mar. 7, 2011

(65) Prior Publication Data

US 2012/0161624 A1 Jun. 28, 2012

(30) Foreign Application Priority Data

Dec. 27, 2010 (CN) ..... 2010 1 0606900

(51) Int. Cl.
*F21V 29/00* (2006.01)

(52) U.S. Cl.
USPC ..... 362/264; 362/294

(58) Field of Classification Search
USPC ..... 362/264, 265, 294, 375, 800
See application file for complete search history.

(56) References Cited

U.S. PATENT DOCUMENTS 7,682,049 B2 * 3/2010 Zheng et al. ..... 362/294
7,726,846 B2 * 6/2010 Yang et al. ..... 362/294

* cited by examiner

*Primary Examiner* — Vip Patel
(74) *Attorney, Agent, or Firm* — Altis Law Group, Inc.

(57) ABSTRACT

An LED bulb includes a connector for electrically connecting with a power supply, a heat sink disposed on the connector, an LED module mounted the heat sink, and an envelope secured to the heat sink and covering the LED module. The heat sink includes a tubular body, a plurality of first fins extending outwardly from an outer circumference of the tubular body, and a plurality of second fins extending inwardly from an inner circumference of the tubular body.

20 Claims, 4 Drawing Sheets

LED BULB

BACKGROUND

1. Technical Field

The disclosure relates to LED (light emitting diode) bulbs for illumination purpose and, more particularly, relates to an LED bulb having a good heat dissipation.

2. Description of Related Art

LED bulbs are a type of solid-state lighting that utilizes LED as a light source for indoor or outdoor illumination. An LED bulb generally requires a plurality of LEDs mostly driven at the same time, which results in a rapid rise in operating temperature of the LEDs. However, since the bulb lacks effective heat dissipation mechanisms, continuous operation of the LED bulb can cause overheat of the LEDs, resulting in flickering or even malfunction of the LEDs.

What is needed, therefore, is an improved LED bulb which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
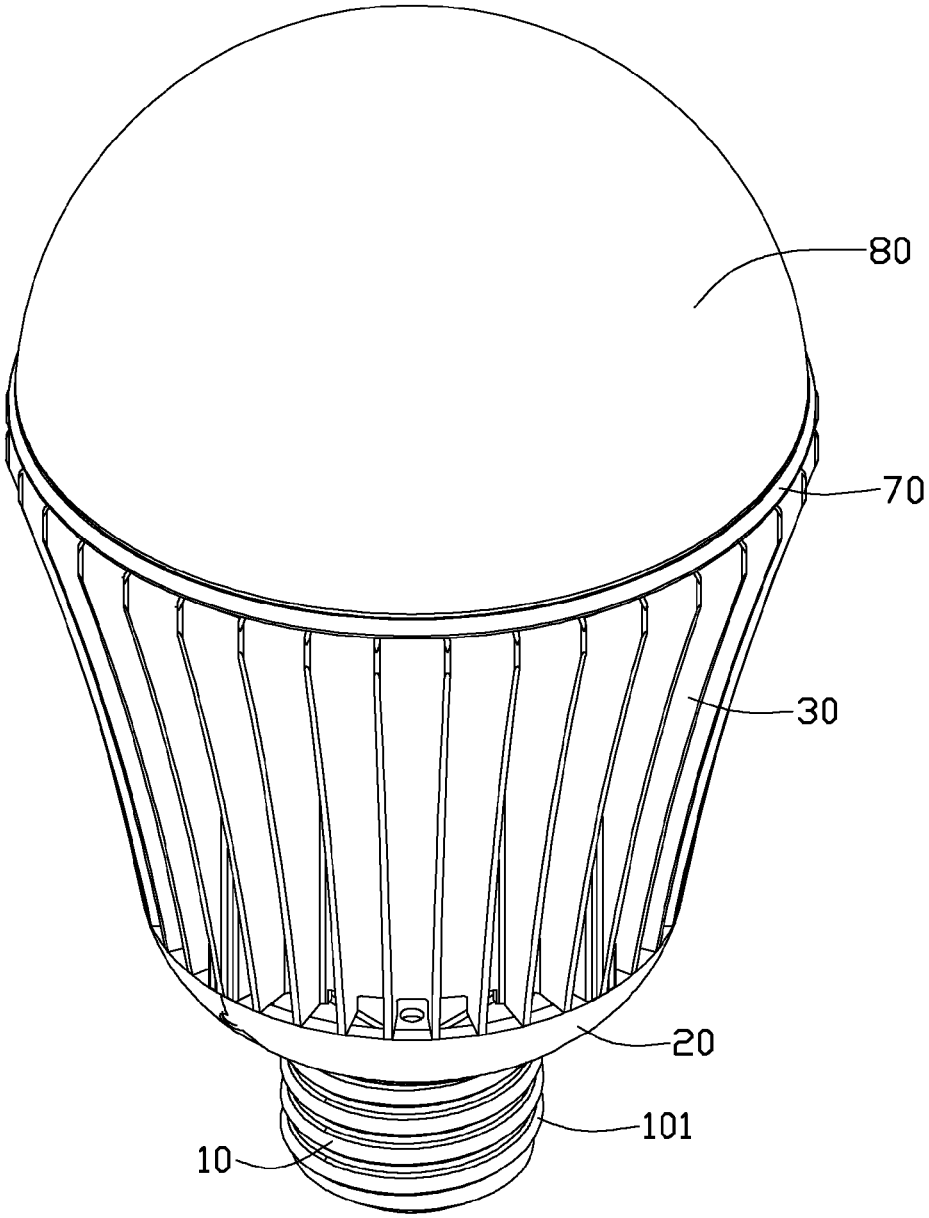
FIG. 1 is an assembled view of an LED bulb in accordance with an embodiment of the disclosure.
Figure 2:
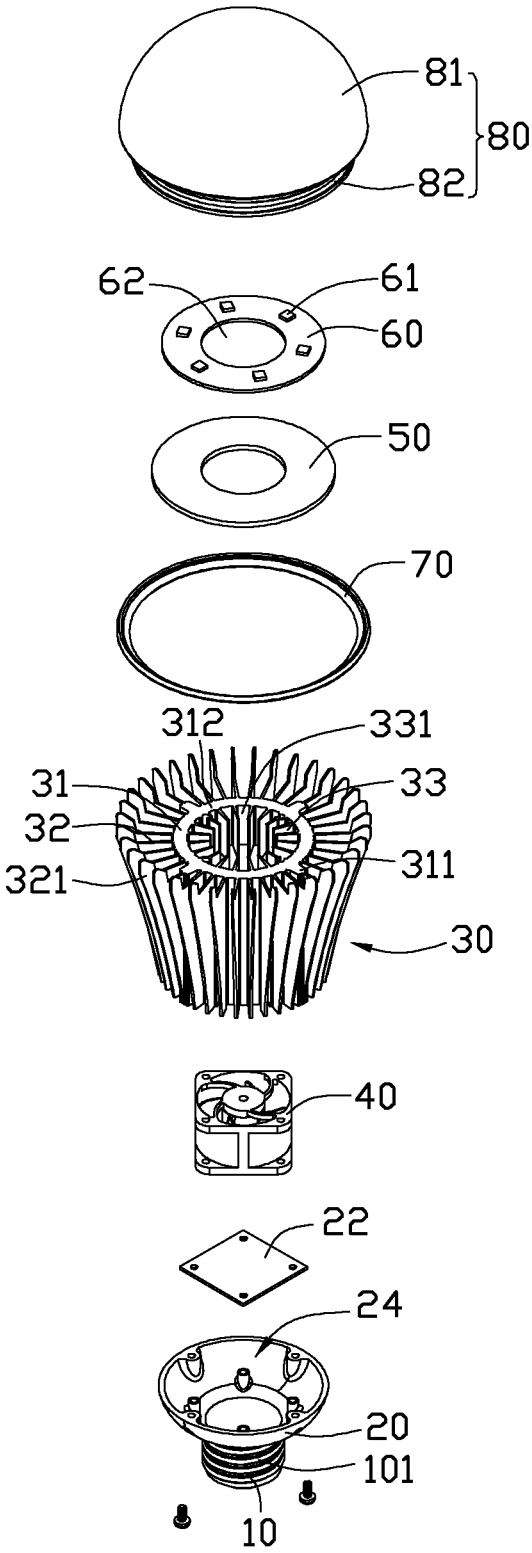
FIG. 2 is an exploded view of the LED bulb of FIG. 1.

Referring to FIGS. 1 and 2, a light emitting diode (LED) bulb in accordance with an embodiment of the disclosure is illustrated. The LED bulb comprises a connector 10, a seat 20 engaging with the connector 10, a heat sink 30 disposed on the seat 20, a fan 40 received in the heat sink 30, a cover board 50 disposed on the heat sink 30, an LED module 60 mounted on the cover board 50, and an envelope 80 secured to the heat sink 30 and covering the LED module 60.

The connector 10 is used to electrically connect with a power supply. The connector 10 is a standard cap defining a plurality of threads 101, which can be suited with a conventional lamp socket. The seat 20 is bowl-shaped and fixed on a top of the connector 10. The seat 20 defines a cavity 24 therein for accommodating a driving module 22 which is electrically connected to the connector 10 and the LED module 60. The driving module 22 is configured for providing driving voltage for the LED module 60.

Figure 3:
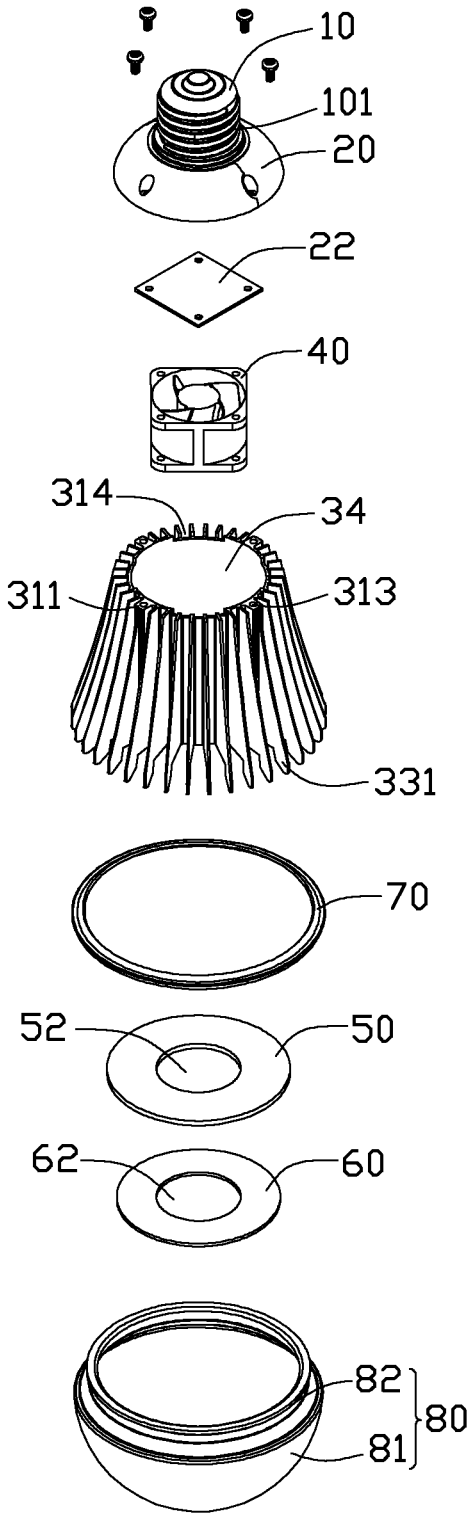
FIG. 3 is an inverted view of the LED bulb of FIG. 2.
Figure 4:
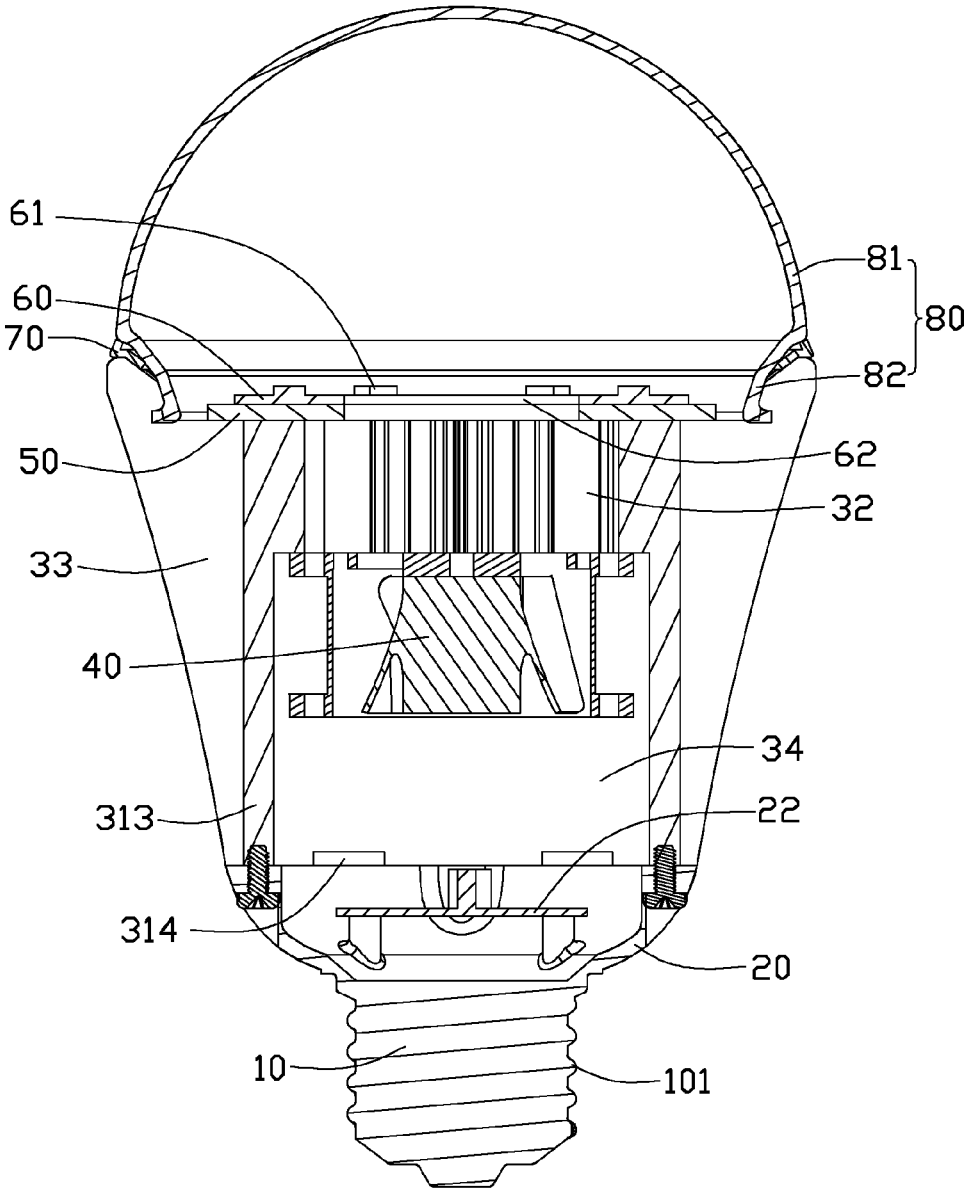
FIG. 4 shows a cross sectional view of the LED bulb of FIG. 1.

Referring to FIGS. 3 and 4 also, the heat sink 30 is integrally made of aluminum by extrusion. The heat sink 30 comprises a tubular body 31, a plurality of first fins 32 integrally extending outwardly from an outer circumference of the tubular body 31, and a plurality of second fins 33 extending inwardly from an inner circumference of the tubular body 31. The tubular body 31 defines a through hole 34 in a central portion thereof. The second fins 33 are located in an upper portion of the through hole 34 and surrounded by the tubular body 31. The fan 40 is correspondingly received in a lower portion of the through hole 34 without the second fins 33 therein. The fan 40 is located under the second fins 33. A center of a top face of the heat sink 30 is concaved downwardly to form a depression 312. In this embodiment, a portion of each of the first fins 32 adjacent to the tubular body 31, the tubular body 31 and the second fins 33 synchronously concave downwardly to cooperatively form the depression 312. A portion of each of the first fins 32 remote from the tubular body 31 forms a finger, the fingers of the first fins 32 are around the depression 312. The depression 312 has a flat face on which the cover board 50 is attached. A plurality of protruding ribs 311 protrude outwardly and perpendicularly from the outer circumference of the tubular body 31. The protruding ribs 311 are equally spaced from each other. Each of the protruding ribs 311 is positioned between two neighboring first fins 32. A screw hole 313 is defined in a central portion of a bottom end of each protruding rib 311. The first fins 32 are spaced from each other, and each are extended from the tubular body 31 along a radially outward direction. A first passage 321 is defined between every two neighboring first fins 32. The second fins 33 are spaced from each other. A second passage 331 is defined between every two neighboring second fins 33. The first and second fins 32, 33 are arranged along a circumferential direction of the tubular body 31. A bottom of the heat sink 30 is engaged with the seat 20. A plurality of airflow inlets 314 are defined at the bottom of the heat sink 30 along a circumferential direction thereof. The airflow inlets 314 are communicated with the through hole 34 of the heat sink 30. Airflow drawn by the fan 40 flows from the airflow inlets 314, through the through hole 34, blows to the second fins 33, the tubular body 31, the LED module 60, and the first fins 32, and then through the passages between the first fins 32 to an outer environment. The forced airflow from the fan 40 forces heat generated by the LED module 60 and heat absorbed by the second fins 33, the tubular body 31 and the first fins 32 to be dissipated outwards rapidly.

The cover board 50 is annular, and defines a first hole 52 at a center thereof. The cover board 50 is secured on the flat face of the depression 312 of the heat sink 30. The LED module 60 is thermally attached on the cover board 50. The LED module 60 comprises a plurality of LEDs 61. It is understood that the number of the LED 61 is not limited to the present embodiment; the number of the LED 61 can also be two, three, etc.. The LED module 60 is annular, and defines a second hole 62 at a center thereof. The first and second holes 52, 62 are communicated with the through hole 34 of the heat sink 30. The LED module 60 is received in the depression 312 of the heat sink 30, the fingers of the first fins 32 are around the LED module 60.

The envelope 80 is disposed on the top face of the heat sink 30 and correspondingly covers the LED module 60. The envelope 80 is integrally formed of a transparent or semitransparent material such as glass, resin or plastic. The envelope 80 comprises a bowl-shaped body 81 and an engaging flange 82 extending downwardly from a periphery of a bottom end of the body 81. The engaging flange 82 of the envelope 80 is fitly engaged with the depression 312 of the heat sink 30. The fingers of the first fins 32 of the heat sink 30 hold the engaging flange 82 in the depression 312 of the heat sink 30 along a circumferential direction of the engaging flange 82. Furthermore, the envelope 80 can function to modulate the light generated by the LEDs 61 to have a desired pattern.

The LED bulb further comprises an annular gasket 70 sandwiched between the engaging flange 82 of the envelope 80 and the fingers of the first fins 32 of the heat sink 30. The gasket 70 is made of rubber, for increasing the sealing performance of the LED bulb.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED bulb comprising:

a connector for being electrically connected to a power supply;

a heat sink disposed on the connector, the heat sink comprising a tubular body defining a through hole at a center thereof, a plurality of first fins extending outwardly from an outer circumference of the tubular body, and a plurality of second fins extending inwardly from an inner circumference of the tubular body, the second fins being located in the through hole and being surrounded by the tubular body;

an LED module mounted on the heat sink; and an envelope secured to the heat sink and covering the LED module.

2. The LED bulb as described in claim 1, wherein a center of a top face of the heat sink is concaved downwardly to form a depression, and the LED module is received in the depression.

3. The LED bulb as described in claim 2, wherein the envelope comprises a bowl-shaped body and an engaging flange extending downwardly from a periphery of a bottom end of the body, the engaging flange being engagingly received in the depression of the heat sink.

4. The LED bulb as described in claim 3 further comprising an annular gasket sandwiched between the engaging flange of the envelope and the heat sink.

5. The LED bulb as described in claim 2, wherein a portion of each of the first fins adjacent to the tubular body, the tubular body and the second fins synchronously concave downwardly to cooperatively form the depression.

6. The LED bulb as described in claim 5, wherein a portion of each of the first fins remote from the tubular body forms a finger, the fingers of the first fins being around the LED module in the depression.

7. The LED bulb as described in claim 6, wherein the fingers of the first fins hold a portion of the envelope in the depression.

8. The LED bulb as described in claim 1, wherein the LED module is annular and defines a first hole at a center thereof, and the first hole is communicated with the through hole of the heat sink.

9. The LED bulb as described in claim 8, wherein a plurality of airflow inlets are defined at the bottom of the heat sink, and the airflow inlets are communicated with the through hole of the heat sink.

10. The LED bulb as described in claim 9, further comprising a fan received in the through hole of the heat sink.

11. The LED bulb as described in claim 10, wherein the first fins are spaced from each other, and a passage is defined between every two neighboring first fins.

12. The LED bulb as described in claim 11, wherein airflow drawn by the fan flows from the airflow inlets, through the through hole, and then through the passages between the first fins to an outer environment.

13. The LED bulb as described in claim 11, wherein the first fins each are extended from the tubular body along a radially outward direction.

14. The LED bulb as described in claim 1, wherein the heat sink is made of aluminum by extrusion.

15. The LED bulb as described in claim 1, further comprising a seat fixed on a top of the connector, wherein the heat sink is disposed on the seat.

16. The LED bulb as described in claim 15, wherein the seat defines a cavity therein for accommodating a driving module which is electrically connected to the connector and the LED module.

17. An LED bulb comprising:

a connector for being electrically connected to a power supply;

a heat sink disposed on the connector, the heat sink comprising a tubular body defining a through hole at a center thereof, a plurality of first fins extending outwardly from an outer circumference of the tubular body, and a plurality of second fins extending inwardly from an inner circumference of the tubular body;

an LED module mounted on the heat sink;

a fan being received in the through hole under the second fins and being surrounded by the tubular body of the heat sink; and an envelope secured to the heat sink and covering the LED module.

18. The LED bulb as described in claim 17, wherein a portion of each of the first fins remote from the tubular body forms a finger, and the fingers of the first fins are around the LED module.

19. The LED bulb as described in claim 18, wherein a portion of each of the first fins adjacent to the tubular body, the tubular body and the second fins synchronously concave downwardly to cooperatively form a depression, the LED module being located in the depression.

20. The LED bulb as described in claim 18, wherein the fingers of the first fins hold a lower portion of the envelope along a circumferential direction of the lower portion.

* * * * *